US008186495B2

(12) United States Patent
Gauselmann

(10) Patent No.: US 8,186,495 B2
(45) Date of Patent: May 29, 2012

(54) METHOD FOR OPERATING A TRANSPORT UNIT FOR TRANSPORTING PAPER CURRENCY FROM AN INTAKE AND TESTING UNIT TO A STORAGE DEVICE

(75) Inventor: Paul Gauselmann, Espelkamp (DE)

(73) Assignee: ADP Gauselmann GmbH, Espelkamp (DE)

( * ) Notice: Subject to any disclaimer, the term of this patent is extended or adjusted under 35 U.S.C. 154(b) by 118 days.

(21) Appl. No.: 12/556,904

(22) Filed: Sep. 10, 2009

(65) Prior Publication Data

US 2010/0078365 A1 Apr. 1, 2010

(30) Foreign Application Priority Data

Sep. 11, 2008 (DE) ..... 10 2008 046 811

(51) Int. Cl.
*B65H 5/34* (2006.01)

(52) U.S. Cl. ..... 194/206; 271/270

(58) Field of Classification Search ..... 194/206, 194/207; 271/270
See application file for complete search history.

(56) References Cited

U.S. PATENT DOCUMENTS

| | | | | |
|---|---|---|---|---|
| 4,453,667 | A * | 6/1984 | Zerfahs | 232/7 |
| 6,371,473 | B1 * | 4/2002 | Saltsov et al. | 271/3.01 |
| 2004/0182675 | A1 * | 9/2004 | Long et al. | 194/206 |

FOREIGN PATENT DOCUMENTS

| | | | |
|---|---|---|---|
| DE | 41 38 261 | A1 | 11/1991 |
| DE | 198 29 458 | A1 | 1/2000 |
| DE | 199 03 988 | A1 | 8/2000 |
| DE | 10 2006 060 619 | A1 | 6/2008 |
| GB | 1 539 673 | A | 1/1979 |

* cited by examiner

*Primary Examiner* — Mark Beauchaine
(74) *Attorney, Agent, or Firm* — Ursula B. Day; Henry M. Feiereisen

(57) ABSTRACT

A method for the operation of a transport system for bank notes whereby a bank note is conveyed from a tester unit to a bank note storage device, as well as a device for taking up bank notes in which a bank note storage and stacking unit is controlled by differing transport speeds such that the transport speed in the transport unit that takes up the bank note is higher than the transport speed in the device that delivers the bank note to a second transport unit.

12 Claims, 1 Drawing Sheet

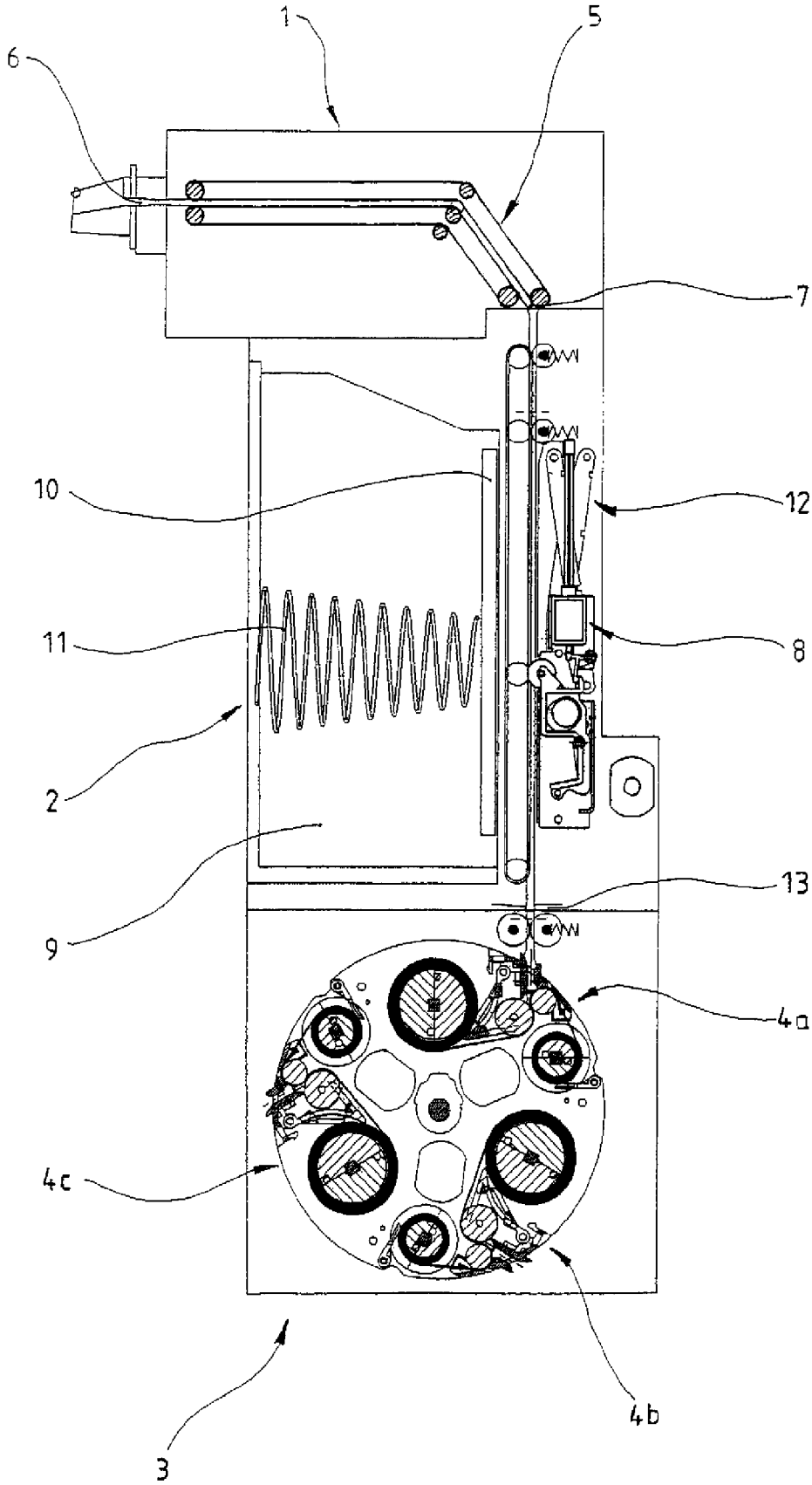
1
5
6
7
10
12
11
8
2
9
13
4a
4c
4b
3

METHOD FOR OPERATING A TRANSPORT UNIT FOR TRANSPORTING PAPER CURRENCY FROM AN INTAKE AND TESTING UNIT TO A STORAGE DEVICE

CROSS-REFERENCES TO RELATED APPLICATIONS

This application claims the priority of German Patent Application No. 10 2008 046 811.8, filed Sep. 11, 2008, pursuant to 35 U.S.C. 119(a)-(d), the subject matter of which is incorporated herein by reference.

BACKGROUND OF THE INVENTION

The invention refers to a method of operating a transport system for transporting paper currency and in particular, a transport system which transports the paper currency from an in intake and testing unit to a device for the storage of the paper currency.

In the context of the present invention, the terms "paper payment medium", "bank note", "currency", "paper currency" or "bills" are interchangeable terms designating paper or paper like legal tender as payment means.

From DE 41 38 261 A1, a method is known for the stacking of bank notes. A device for testing the genuineness and value of bank notes is followed by a device for the stacking of bank notes. The device includes a bank note delivery chamber with piston operable by an auxiliary power source with which the bank notes are moved into a bank note collection space. The transporting of the bank notes from the intake unit to the bank note stacking device is carried out by means of a transport system, which can be activated independently from the bank note testing unit. A drawback thereby is that the speed for the delivery of the bank note must be synchronized with the speed at which the bank note is conveyed from the accepting device to the subsequent transport system. If the transport unit has a lower transport speed than that of the bank note testing unit, then the bank notes are being moved by the bank note tester to the transport unit in such a way that they are pushed into each other in a Z-shaped manner after which they subsequently get jammed in the transport system.

Furthermore, from the DE 198 29 458 A1 a device for the storage and output of bank notes is known. An arrangement includes a bank note tester, which is followed by a bank note stacking unit and following the stacking unit is a bank note roller magazine. A transport unit for the transport of the bank notes consists of two endless toothed belts extending parallel to each other. The toothed belts are guided via corresponding drive- and deflection rollers, such that the bank notes can be conveyed between the toothed belts and transported along the predetermined transport distance. The output of a bank note from the roller magazine takes place by means of opposite activation of the roller magazine and the bank note transport system. However, a jam in the form of Z-shaped folded bank notes in the delivery area from the roller magazine to the transport system cannot be ruled out.

It would therefore be desirable and advantageous to address these prior art problems and to obviate other prior art shortcomings.

SUMMARY OF THE INVENTION

According to one aspect of the present invention an improved bank note stacking device is provided in order to realize a problem-free transfer from one transport unit to a further bank note transport unit. The method for operating a transport unit for transport bank notes from a bank note verification- and uptake unit to a device for the storage of bank notes includes that the unit for verification of the bank notes and the transport unit each having an independent control unit from which each of the auxiliary force driven actuators are activated such that the transport speed in the transport unit for the intake of the bank note is higher than the transport speed in the unit which delivers the bank note, and the transport speed in the transport unit is lower at the delivery of a bank note to a further unit than the transport speed in the unit to which the bank note is being conveyed.

An assembly for input, output and storage of bank notes comprising: first and second transport units and one or more roller magazines; wherein the first transport unit operates at a constant transport speed by means of a control unit, while the second transport unit operates at a variable speed by means of another control unit, such that bank notes entered in the system are conveyed through the first transport unit at a constant speed and thereafter are delivered to the second transport unit where they travel at a transport speed that is variable, wherein the transport speed of the second transport unit is adjusted so as to avoid a jam of bank notes before the bank notes enter the roller magazine for storage or are delivered from the roller magazine.

The present invention resolves prior art problems by always maintaining a transport speed difference between the two transport units, whereby it is realized that the bank note is directly pulled in by the receiving transport unit so that in the transfer area from one transport unit to the other transport unit, a secure transfer is realized such that any Z-shaped folding of the bank notes is prevented.

In the device in which the bank note is examined for its genuineness and its value, the transport speed is maintained at a constant speed for the uptake as well as the delivery of the bank notes. The subsequent unit for transporting the bank notes varies in its speed. At intake of the bank notes in this unit, the transport speed is higher than the transport speed in the unit for examining the bank notes for genuineness and value, the acceptor. When output of the bank notes is required, the transport speed is lower than the speed of the acceptor. In order to prevent possible jams in the transfer area from one bank note transport unit to the other or to the storage medium, it is particularly advantageous, when utilizing bank note roller magazines, to control the transport unit in the bank note roller magazine such that the transport band pulling drive motor is stopped earlier than the drive motor that pushes the conveyor band. Thereby, it is realized that the transport band in the roller magazine in the delivery area is free of tension and the bank note that is delivered to the further transport unit is received without any impediment.

DETAILED DESCRIPTION OF PREFERRED EMBODIMENTS

Other features and advantages of the present invention will be more readily apparent upon reading the following description of a currently preferred exemplified embodiment of the invention with reference to the accompanying drawing, FIG. 1. This depicted embodiment is to be understood as illustrative of the invention and not as limiting in any way. It should also be understood that the FIGURE is not necessarily to scale and that the embodiment is sometimes illustrated by graphic symbols, phantom lines, diagrammatic representations and fragmentary views. In certain instances, details which are not necessary for an understanding of the present invention or which render other details difficult to perceive may have been omitted.

FIG. 1 shows a device for the uptake as well as the verification of the genuineness of banknotes through an acceptor 1, which is connected to a device for stacking the bank notes. Beneath the device 2 for the stacking of bank notes, is a device 3, which includes three bank note roller magazines 4*a*-4*c*, which are each pivotable into a bank note transfer position.

The device 1 for the uptake and testing of the bank notes genuineness includes a transport unit 5 which comprises endless bands as well as transport- and drive rollers located in opposite disposition to each other for the transport therebetween of a bank note not shown here in detail. The transport unit 5 is configured in such a manner that the bank notes can be conveyed from an intake opening 6 to a delivery opening 7 or vice versa, from the delivery opening 7 to the intake opening 6. The control of a drive motor for the transport unit 5 of device 1 is carried out by means of a control unit of the device 1 and is not shown here in detail. The delivery opening 7 of device 1 is followed by a transport unit 8 of a bank note stacking unit 2. The transport unit 8 consists of two endless bands in parallel disposition to each other with corresponding press rollers as well as a motor drive. A bank note stacking till 9 from which bank notes can be taken is disposed perpendicular to the longitudinal axis of the transport unit 8. A spring loaded stacking floor 10 is disposed in the bank note stacking till 9. A pressure spring 11 is supported on one end at the stacking floor 10 and at the other end, supported at a rear wall of the bank note stacking till 9. A scissor design lifting system 12 driven by an electrical motor is disposed at the side opposite the bank note stacking bottom 10 and assigned to the delivery opening to the bank note stacking till 9. An auxiliary force operated drive activates the lifting system 12 in such a manner that the lifting system deflects and thereby presses a bank note into the bank note stacking till 9.

The transport unit 8 terminates at an input/output opening 13 of a device 3 for storing the bank notes in three roller magazines. The device 3 which is configured as a revolving device is fastened in form- or force-fitting manner at the bottom of a housing in which the bank note stacking till 9 is disposed.

The assembly of the entire device is modular, such that instead of the bank note stacking till 9 the device 3 can be also disposed underneath the acceptor 1. The system can also be operated with only one bank note stacking till 9 or only with the device 3.

The transport unit 8 of bank note stacking till 9 comprises a dedicated electro-motor driven actuator and a control unit. The device 3 also includes controls for each of the bank note roller magazines 4*a*-4*c*. Moreover, a further control unit is contemplated for activating the drive for moving the bank note roller magazine 4*a*-4*c* into the proper transfer position 13.

When a bank note is put into device 1, then by means of the transport unit 5 of device 1, the bank note is moved to a delivery opening. The transport speed, respectively the transmitting speed of the transport unit 5 in both transport directions is constant.

A sensor, which is not shown here in detail, associated with the delivery opening and also in operative connection with the control unit of the transport unit 8, exhibits a transport or transmitting speed which is up to 60% higher that of the transport unit 5. Thereby, it is realized that in the delivery area from the transport unit 5 to the transport unit 8, the banknote is taken up by transport unit 8 and under the influence of a pulling action stretched and drawn from the transport unit 5. Thus, a jam in the transfer area due to the Z-shaped folding of the bank is avoided.

If the bank note in one of the roller magazines 4*a*-4*c* is to be transported, then the transport speed of the transport unit 8, after successful transfer of the bank note from acceptor 1, is slowed down. The roller speed-, respectively the transport speed of the roller magazine 4*a*-4*c*, is constant. The control unit of transport unit 8 reduces the transport- or the transport speed such that it will be about 20% below the speed of the transport speed of the roller magazine 4*a*-4*c*. Due to the difference in speed, the bank note is being pulled by the transport system of the roller magazine from the transport unit 8 to thus prevent the Z-shaped folding of the bank note in the delivery area.

Upon output of a bank note from one of the roller magazines 4*a*-4*c*, the control of the roller magazine 4*a*-4*c* arrests the pulling actuator prior to the pushing actuator. Thereby, the transport band in the roller magazine becomes relaxed and the bank note can be taken up more easily by the transport unit 8 from the roller magazine 4*a*-4*c*. The transport unit 8 has a higher transport and transport speed than the transport band in the roller magazine 4*a*-4*c*. Subsequently, the bank note is delivered from the transport unit 8 to the transport unit 5. The transport speed of the transport unit 8 is reduced such that it is distinctly below the transport speed of the transport unit 5.

While the invention has been illustrated and described as embodied in a method for transport bank notes, it is not intended to be limited to the details shown since various modifications and structural changes may be made without departing in any way from the spirit of the present invention. The embodiment was chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

What is claimed is:

1. A method for operating a transport device for bank notes comprising the steps of:

testing genuineness and value of a bank note in a testing unit serving as a first transport unit for transporting the incoming bank note, further transporting the bank note with a second transport unit to a storage unit having an internal transport device; wherein each of the transport units and the internal transport device are separately under the control of a respective control unit for control of transport speeds; wherein the transport speed of the second transport unit is controlled by the respective control unit to be variable, such that upon transfer of an incoming banknote from the first transport unit, the speed of second transport unit increases to be greater than the speed of the first transport unit which is constant, while upon transfer of the bank note to the storage unit, the speed of the second transport unit decreases to be less than the transport speed of the internal transport device.

2. The method according to claim 1, wherein the transport speed of the first transport unit and the transport device in the storage unit remains constant and the transport speed of the second transport unit varies.

3. The method according to claim 1, wherein the storage unit is configured as at least one of, a stacking till and a unit having one or more roller magazines, and wherein the second transport unit is delivering the bank note to either one of the roller magazines or the stacking till.

4. The method according to claim 3, wherein the bank note after transporting into the one roller magazine, the bank note is taken up by the internal transport device of the roller magazine which includes a pulling actuator and a pushing actuator, and after the bank note reaching a delivery position, the pulling actuator is arrested prior to the pushing actuator being arrested.

5. The method according to claim 1, wherein the difference in the transport speed between the first and the second transport units is from 30-70%.

6. The method of claim 1, wherein each of the control units is activates a respective actuator.

7. A method for operating a transport device for bank notes comprising the steps of:

testing genuineness and value of a bank note in a testing unit, transporting the bank note by a first transport unit and thereafter transporting the bank note by a second transport unit delivering the bank note to a storage till or to a storage device with a dedicated transport system;

controlling each of the transport units separately by a respective control unit activating an actuator;

maintaining the transport speed of the first transport unit and the dedicated transport unit at a constant transport speed and controlling the transport speed of the second transport unit at a variable level when delivering the bank notes to or from the storage device, wherein the speed of second transport unit increases to be greater than the speed of the first transport unit, while upon transfer of the bank note to the storage unit, the speed of the second transport unit decreases to be less than the transport speed in the storage device.

8. The method of claim 7, wherein during transfer of the bank note into the storage device, the transport speed of the second transport unit is lower than the transport speed of an internal transport device of the roller magazine, and wherein transferring the bank note from the storage device, the transport speed of the second transport is higher than the transport speed of the transport device in the roller magazine, and passing the bank note from the second transport unit to the first transport unit, the transport speed of the second transport unit is lowered such that it is lower than the transport speed of the first transport unit.

9. An assembly for input, output and storage of bank notes comprising: first and second transport units and one or more roller magazines for storage; wherein the first transport unit and the roller magazines operate at a constant transport speed by means of a respective control units, while the second transport unit operates at a variable speed by means of another control unit, such that bank notes entered in the system are conveyed through the first transport unit at a constant speed and thereafter are delivered to the second transport unit where they travel at a transport speed that is variable, wherein the transport speed of the second transport unit is adjusted to be either higher or lower than the transport speed in the first transport unit and the roller magazine so as to avoid a jam of bank notes before the bank notes enter the roller magazine for storage or at output from storage.

10. The assembly of claim 9, wherein the transport speed of the second transport unit is up to 60% higher than that of the first transport unit.

11. The assembly of claim 9, wherein each of the one or more roller magazines include an internal transport device for transporting the bank notes within the roller magazine and includes a pulling actuator and a pushing actuator; wherein the internal transport device is operated at a constant speed but at a transport speed that is higher than the transport speed of the second transport unit when the bank note is incoming, whereby the bank note is pulled from the second transport system and bunching up of the bank note is avoided.

12. The assembly of claim 11, wherein output of the bank note from the roller magazine is realized by the pulling actuator being arrested before the pushing actuator is arrested in order to relax a band of the transport device and wherein the second transport unit is operated at a higher transport speed than the transport device of the roller magazine upon output of the bank note from the roller magazine.

* * * * *